United States Patent [19]

Melan et al.

[11] 4,205,800

[45] * Jun. 3, 1980

[54] STRAND ATTENUATION AND WINDING APPARATUS

[75] Inventors: Giuseppe-Fabrizio M. Melan, Chambery; Jean R. Nicoulaud, Challe-les-Eaux, both of France

[73] Assignee: Saint-Gobain Industries, Neuilly-sur-Seine, France

[ * ] Notice: The portion of the term of this patent subsequent to Aug. 9, 1994, has been disclaimed.

[21] Appl. No.: 884,695

[22] Filed: Mar. 8, 1978

Related U.S. Application Data

[60] Continuation-in-part of Ser. No. 822,208, Aug. 3, 1977, which is a division of Ser. No. 630,925, Nov. 11, 1975, Pat. No. 4,040,572.

[30] Foreign Application Priority Data

Mar. 23, 1977 [FR] France ..... 77 08655

[51] Int. Cl.[2] ..... B65H 54/02; B65H 75/28

[52] U.S. Cl. ..... 242/18 A; 242/18 PW; 242/125.1

[58] Field of Search ..... 242/18 PW, 18 A, 18 G, 242/125.1

[56] References Cited

U.S. PATENT DOCUMENTS

| | | | |
|---|---|---|---|
| 3,345,003 | 10/1967 | Mattingly et al. | 242/18 A |
| 3,539,317 | 11/1970 | Smith | 242/18 G |
| 3,741,488 | 6/1973 | Wuest | 242/18 PW |
| 3,876,161 | 4/1975 | Miller | 242/18 A |
| 3,936,006 | 2/1976 | List et al. | 242/18 A |
| 4,040,572 | 8/1977 | Melan et al. | 242/18 PW |
| 4,069,984 | 1/1978 | Klink et al. | 242/18 PW |

FOREIGN PATENT DOCUMENTS

| | | | |
|---|---|---|---|
| 47-5220 | 2/1972 | Japan | 242/18 PW |

*Primary Examiner*—George F. Mautz

*Attorney, Agent, or Firm*—Charles H. Lindrooth; John T. Synnestvedt

[57] ABSTRACT

Apparatus and method for winding a continuous strand formed from an attenuable material is disclosed. An end face of a winding collet includes strand-engaging elements spaced about the periphery of the end face of the collet that engage the strand as it is brought against the face of the collet. There are at least three strand-engaging elements on the face of the collet. The strand is conducted from the strand-engaging elements to the starting drum and is wound on the collet until it reaches operating speed. When the winding collet is at its operating speed, the strand is urged onto a winding sleeve to form the winding.

7 Claims, 23 Drawing Figures

1
2
2
3
12
15
16
14
6
5
11
13
70
8
7
9
4
70
70
18
19
20
17

STRAND ATTENUATION AND WINDING APPARATUS

RELATED APPLICATION

This application is a continuation-in-part of our earlier filed application Ser. No. 822,208 filed Aug. 3, 1977, which in turn is a division of application Ser. No. 630,925, filed Nov. 11, 1975 now U.S. Pat. No. 4,040,572, issued Aug. 9, 1977.

FIELD OF THE INVENTION

The present invention relates to the manufacture of strands from attenuable material, for example, a thermoplastic material such as glass, the strands being obtained from the streams of the attenuable material that flow from orifices of a bushing and thereafter harden into filaments.

BACKGROUND OF THE INVENTION

The manufacture of strands from attenuable, thermoplastic materials, for example, glass, by pulling streams of the attenuable material from the orifices of the bushing is, of course, a known process. In this process, the streams of attenuable material harden and solidify into filaments as they are drawn away from the orifices in the bushing. A strand composed of a number of these filaments is wound on a sleeve mounted on a rotating collet. This winding subjects the strand, including the streams of material drawn from the orifices, to a pull or tension that draws out, i.e. attenuates, the portions of the filaments that are not yet hardened or solidified.

In such winding operations, it is necessary from time to time to restart the winding operation, after an interruption, by winding the strand on a new sleeve. The strand wound on each sleeve must be subjected to an unvarying attenuation process throughout the length of the winding so that the diameter of the strand is held as constant as possible. This is accomplished principally by winding the strand at a constant speed. With non-automatic winders (winders having only a single collet that must be stopped when the winding is at capacity, the finished winding manually removed, and a new winding started on the same collet), such restarts are necessary each time a full winding is removed and each time there is a strand rupture. With automatic winders (winders having two or more collets mounted on a turret and mechanism for automatically commencing winding on an empty collet after the winding on a preceding collet has reached capacity) such restarts are necessary after strand ruptures.

However, it should be realized that when the strand prematurely ruptures or when the strand pulling operation is interrupted by the necessity of removing a winding that is at capacity, the pulling operation is slowed or stopped. When the strand is drawn slowly, the streams of attenuable material form relatively large diameter filaments. It is undesirable to have strand formed of these relatively large diameter filaments in a winding, as the winding would be unacceptable to users of the product because of the variations in the diameter.

Prior to this, with non-automatic winders, following the completion of each winding and each time the strand ruptured prematurely during winding, the restarting operation involved the use of two men, one above the winder to pull the filaments from the bushing to restart the filament formation at the bushing and a second man at the level of the winder who, in either case, removed the winding on the collet and restarted a new winding on the collet. In the case of automatic winders it was also necessary to employ two men to restart the winding operation in the event of strand rupture. The restarting operation in the event of strand rupture with automatic winders is essentially the same as that explained previously with respect to non-automatic winders. These prior restarting procedures have several disadvantages. They required the use of two men and the attendant high labor costs. Also, because the labor force in the winding operation was split into two groups, those at the level of the bushings and those at the level of the winders, it was often the case that, while two men were attending to a rupture, or in the case of non-automatic winders, the removal of the finished winding from a collet, that other ruptures or completion of windings at other winders would occur. These could not be attended to until the two men had completed a restart of the first interrupted operation and this resulted in losing winder utilization time and also resulted in the loss of significant amounts of glass.

The invention described and claimed herein provides for the restarting of the winding operation by a man at the level of the bushings. It is possible to reduce the number of men at the level of the winders, as it is only necessary for them to remove full or practically completed strand windings and it is not necessary for them to take the time to work with the man at the bushing level to restart the winding. This allows the man at the bushing level to effect the restart or the reset of the winding more quickly and significantly reduces winder down time and the amount of glass lost during strand ruptures.

In our prior co-pending application, a method and apparatus are described for affixing a continuous strand, notably glass strand, on a collet designed to attenuate the glass and form a winding of the resulting strand. In that application, the collet comprises, at one end, a starting drum on which the strand is affixed as the collet begins rotation. This process is characterized by bringing the strand into contact with the front face of the drum, and then catching it by engaging means that are disposed on the periphery of the drum. The engaging means conduct the strand into a circular groove provided on the drum in a way to wind the thread in this groove until the collet is brought to normal winding speed.

In the arrangements disclosed in our prior application, the thread is applied along a diameter of the front face of the drum, and is caught by two strand-engaging elements disposed along a diameter of this front face. The strand-engaging elements in these prior arrangements comprise slots parallel to the axis of the collet and disposed between the front face of the drum and the groove, to conduct the thread into the groove.

These prior arrangements proved to be satisfactory; however, proper functioning was influenced by alignment of the strand along a diameter of the collet and by the accumulation of size on the front face of the starting drum. Misalignment of the strand or the accumulation of size could cause the strand to be engaged by only one of the strand-engaging slots and this can result in a failure of the strand to wind on the collet.

SUMMARY OF THE INVENTION

In accordance with the invention, the strand is drawn into proximity with a free front face of the winding collet and is seized by strand engaging means placed on the circumference of the collet that leads the strand into a circular groove provided on the collet. A guide element maintains the strand aligned with the groove until the collet has reached its normal winding speed. In accordance with a specific aspect of the invention, the strand engaging means comprise at least three elements positioned on the front face of the collet. According to a preferred mode of implementation of the invention, the strand engaging elements comprise three slots equiangularly arranged on the face of the collet and in communication with a groove on the collet. Additional strand engaging elements may be provided, it being a distinguishing feature of the invention that the operative elements for engaging strand at any one time are spaced at locations which are angularly offset from one another by less than 180°. The apparatus also includes a strand pulling and guiding device that attenuates the strand and brings it into proximity with the front face of the collet to be engaged by the strand-engaging means.

The Applicants have also found that the gripping elements should be regularly spaced on the front face of the starting drum in a way that they do not produce, outside of rotation, prejudicial unbalance of the collet or that other dynamic balancing means should be provided.

In mitigating against the disadvantages discussed above, the Applicants have provided, and this is the principal object of the present application, that the starting drum comprises at least three gripping elements, (slots or similar devices) disposed on the front face, in a way that the angular distance that separates two successive elements, measured from the axis of rotation of the drum, has a constant value.

According to a particularly advantageous characteristic, the starting drum comprises three gripping elements disposed at 120° on the front face of the drum.

According to another characteristic of the present addition, the gripping elements are made in the form of slots or notches whose side walls are inclined at 45° or less on the front face of the starting drum, their connection angle with the front face being the sharpest possible.

As has also been provided in our prior application, the device according to the invention can comprise a thread ejection bar, provided at its extremity with a guide element in the form of a V to maintain the thread in the groove of the starting drum and to wind the thread in this groove.

For reasons that will be explained further, the present application provides that the guide elements in the form of Vs are fixed at the ends of this ejection bar, by the end of one of the two branches of the V-shaped element.

The invention is useful in winding installations having non-automatic winders and also in installations having automatic winders with multiple collets. The invention can be used for winding single strand or multiple strand yarns.

Other characteristics and advantages will be apparent from the following description of the preferred embodiments of the invention, which are presented as examples and are not to be interpreted as limiting the invention claimed.

DETAILED DESCRIPTION OF PREFERRED EMBODIMENTS

Figure 1:
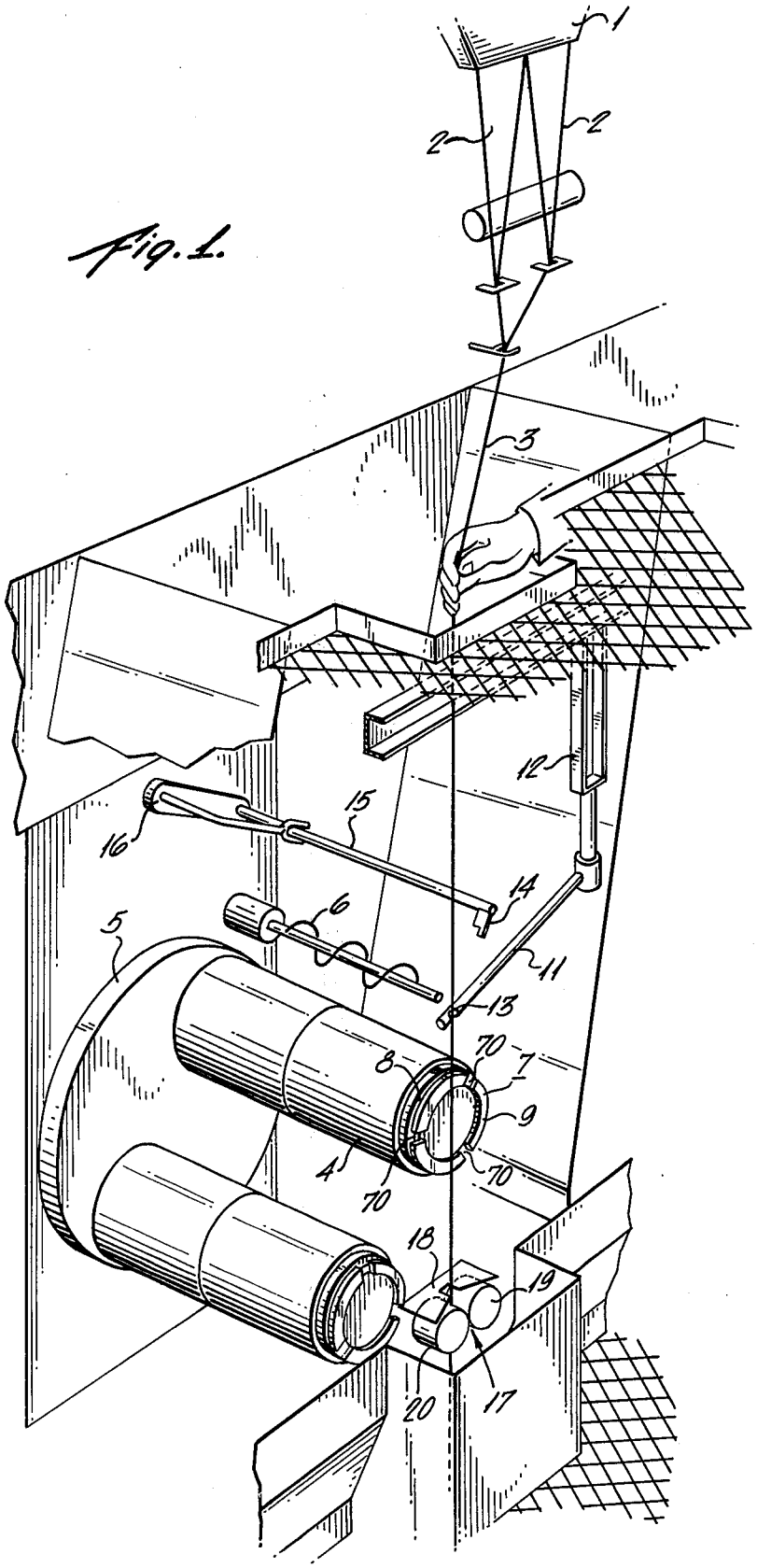
FIG. 1 is a perspective view showing an automatic winder with two collets, to which the invention is applied, the strand being shown engaged in the strand pulling device and not yet engaged by the starting drum.

In FIGS. 1–4, a typical installation is illustrated which comprises a bushing 1 producing filaments 2 that are gathered in a strand 3 in a known manner. This strand is wound on a removable winding sleeve disposed on the collet 4. The winders illustrated in these figures are the automatic type employing at least two collets mounted on a rotatable turret 5, that serves to position the collet alternatively in a winding position and in a winding removal position. The winder shown employs a conventional spiral traversing means 6 for assuring level winding of the strand on the sleeve.

Again referring to FIGS. 1–4, a starting drum 7 is mounted on the free end of each of the collets 4. The starting drum has a groove 8 for receiving strand and three slots 70 in the face 9. The slots extend from the face 9 to the groove 8 and permit communication between the face and the groove. The face 9 is smooth and highly polished so that abrasion of the strand is minimized as it is brought into contact with the face 9.

Figure 19:
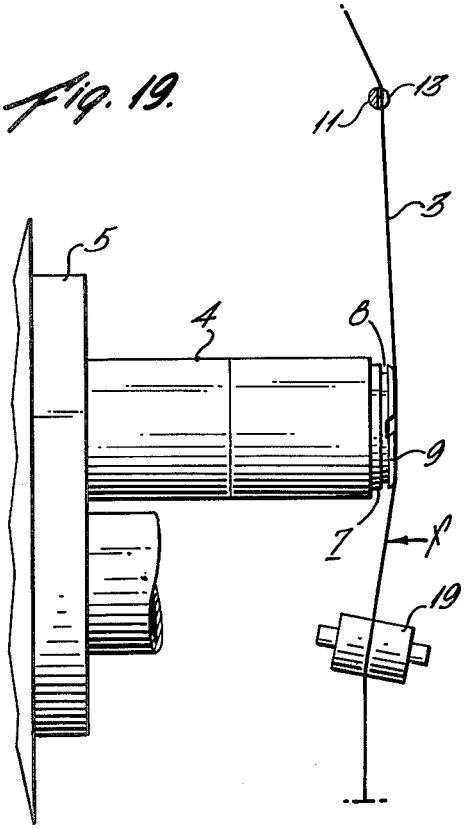
FIG. 19 is a schematic side elevational view showing the positional relationships between the strand pulling device, the starting drum, and the strand retaining finger.

Referring to FIGS. 1–4 and also to FIG. 19, a finger 11, is displaced vertically from the axis of rotation of the collet. This finger is mounted on a support 12, in such a manner that a groove 13 which is formed in the end of finger 11, remains in a fixed position with respect to the starting drum 7.

A strand deflector element 14 is mounted on a bar 15, the bar 15 being mounted on an arm pivotally mounted at 16. The deflector element 14 is composed of a small plate of material resistant to erosion caused by frictional engagement with the moving strand. The element 14 is positioned in such a way that when the bar 15 is pivoted to its functioning position, the element 14 urges the strand out of the groove 13 of the finger 11 and momentarily holds the strand in this position. When the bar 15 is pivoted to its functioning position, the strand is brought into engagement with the level winding mechanism 6 and the winding of the strand package on the collet is commenced.

A strand pulling device 17 is placed beneath the collet 4 that is positioned to have a winding of strand started thereon. The pulling device 17 comprises a V-shaped guide 18 that guides the strand into position between two rollers 19 and 20. The base of the V-shaped guide is slightly recessed beyond the face 9 of the starting drum 7 so that strand drawn between the rollers 19 and 20 can move in the direction of the axis of collet 4 against the face 9.

Figure 7:
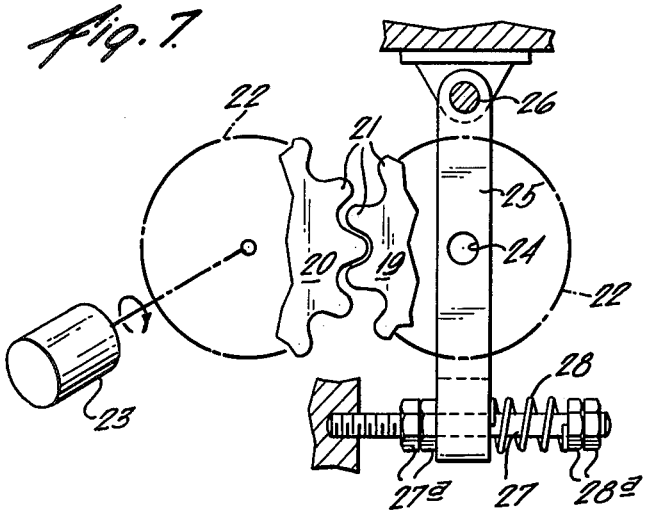
FIG. 7 is a detailed view of the rollers of the preferred form of strand pulling device.

As illustrated in FIG. 7, in a preferred embodiment, the rollers 19 and 20 comprise cogs having rounded teeth 21. The roller 20 is driven by a motor 23 and roller 20 in turn drives roller 19, which is mounted for rotation about an axis 24. Means are provided for adjusting the distance between the pitch circles 22 of the respective rollers 19 and 20, thereby providing for adjustment in the clearance between the rollers. The axle 24 is carried by arm 25 which is mounted on a pivot 26. Thus it can be seen that the roller 19 is mounted for movement toward and away from the roller 20 by means of the pivoted arm 25. The other end of the arm 25 slides on a guide 27. Stops **27*a* are movable along guide 27 to provide for adjustable clearance between the rollers 19 and 20. The spring 28 resiliently biases the arm 25 against the stops 27*a*. The stops 28*a* are movable along the guide 27 and provide for adjusting the bias force of the spring 28. This set-up provides for adjusting the clearance between the rollers and for adjusting the gripping force applied to the strand by the rollers. As is explained later, it is important to regulate the pressure exerted on the strand by rollers 19 and 20** so that the strand ruptures in a desired fashion.

As it will be explained hereinafter in reference to FIG. 19, the axes of rotation of the rollers 19 and 20 are inclined approximately 5° with respect to the axis of rotation of the collet 4.

The apparatus just described is used and functions in the following manner.

A worker at the bushing level gathers the filaments issuing from the bushing and pulls a length of strand sufficient to reach the pulling device 17. The worker guides the strand into the V-shaped guide 18, so that the strand is engaged by the rollers 19 and 20. The strand is also engaged on the finger 11 and is held on a centered position with respect to the face 9 by the groove 13.

Figure 3:
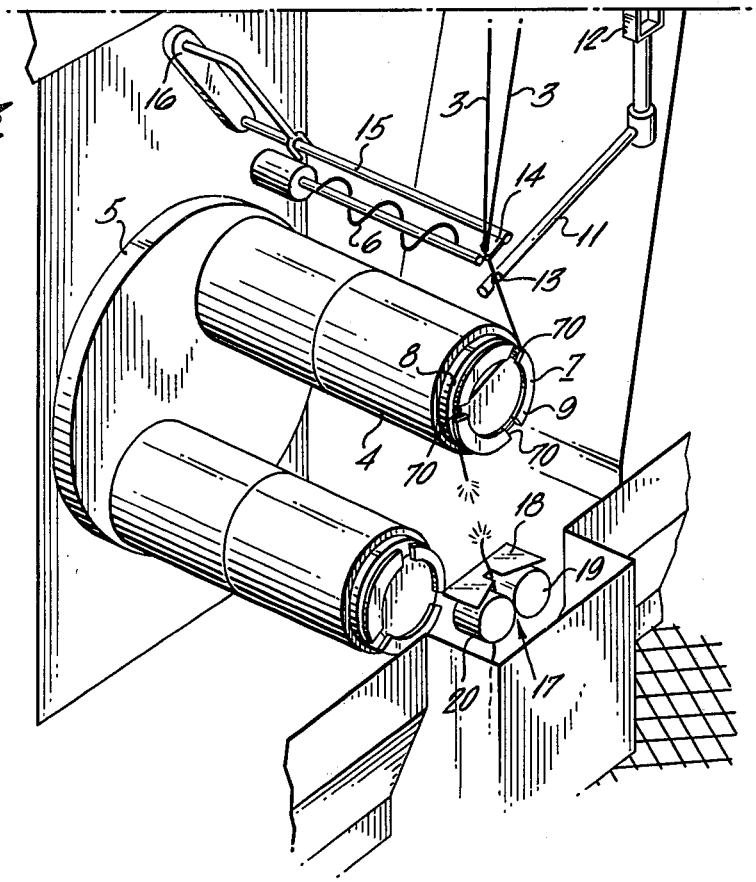
FIG. 3 is a view of the winder shown in FIG. 1, and further shows rupture of the portion of strand disposed between the starting drum and the strand pulling device and winding of the strand on the groove of the starting drum.

The strand pulling device draws the strand at a slow rate and while doing so, draws the strand against the face of the starting drum, as shown in FIG. 19. In our prior co-pending application, as the collet begins rotating, the strand which is situated in a diametrical plane of the starting drum 7 enters two slots 10 which are in the diametrical plane and is held without being able to slip. As the collet continues its rotation the strand is ruptured in the position between the strand puller 17 and the collet as shown in FIG. 3.

Figure 2:
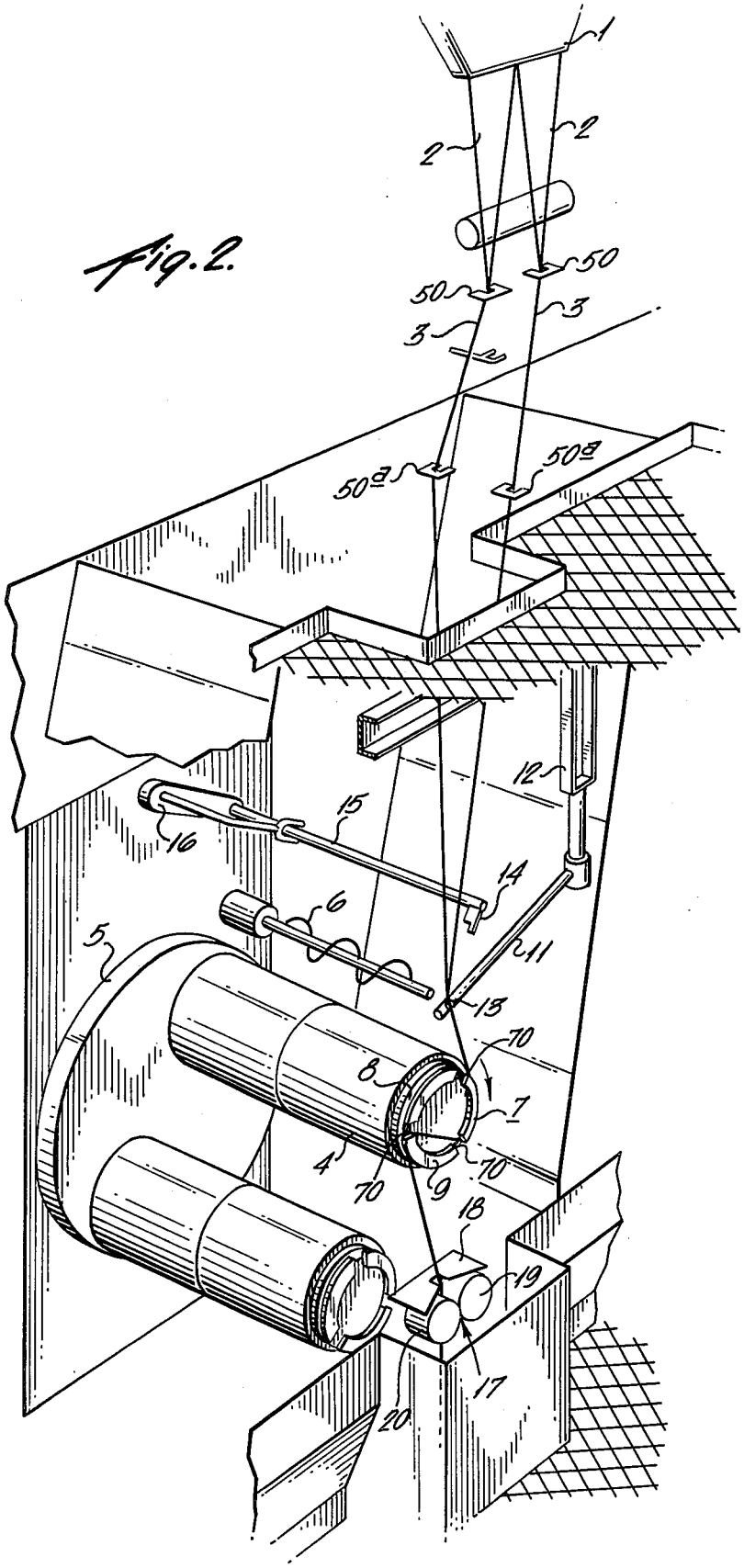
FIG. 2 is a view of the winder shown in FIG. 1 with the strand engaged by the strand engaging means on the starting drum associated with a collet, the strand being held at its lower end by the strand pulling device.
Figure 4:
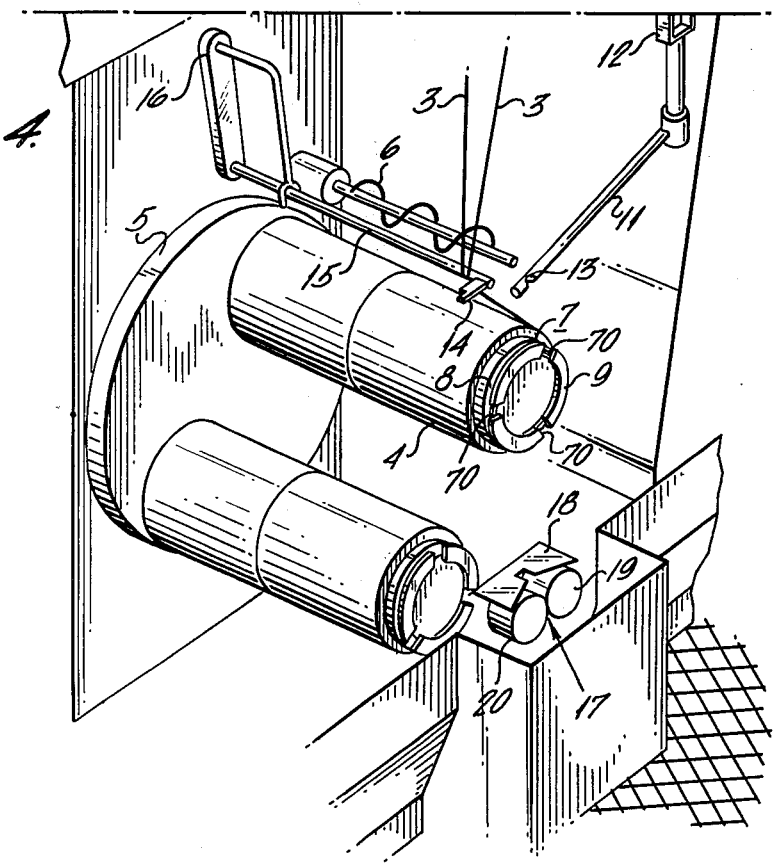
FIG. 4 is a view of the winder as shown in FIG. 1, and further shows the shifting of the strand from the starting drum onto a sleeve on the winding collet, after the collet has reached its operating speed.
Figure 5:
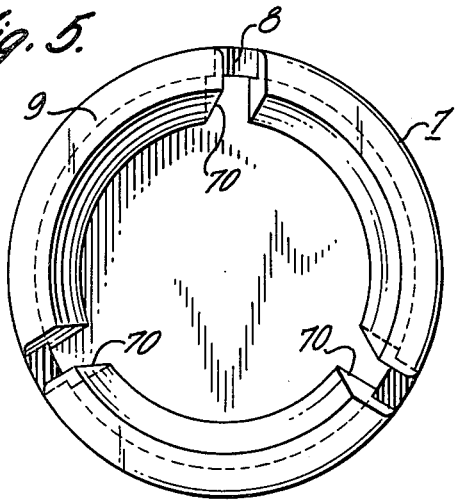
FIG. 5 is an end view of a starting drum formed according to the invention.
Figure 6:
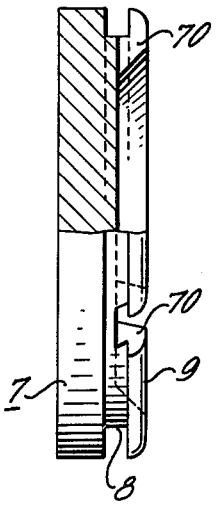
FIG. 6 is a side elevational view, with a portion broken away, of the starting drum of FIG. 5.

While the strand puller attentuates the strand at slow speed, one can proceed to separate the filaments into bundles in order to form two or more small diameter strands. This is accomplished by positioning groups of filaments in the separating combs 50 and countercombs **50*a* (FIGS. 2, 3 and 4**).

Reference is now made to FIGS. 9 through 12 which illustrate a problem which sometimes arises with the apparatus just described, when the strand is not in a diametrical plane. FIGS. 9 through 12 show a starting drum 7 provided with diametrically opposed slots 10 in accordance with the teachings of our co-pending Application.

Figure 9:
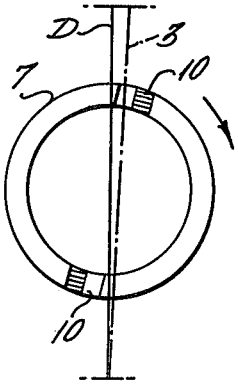
FIGS. 9 through 12 are end views of a starting drum made according to the teachings of our co-pending application, at different rotational positions.

In FIG. 9 the roving or the thread is illustrated as being about to be gripped by one of the slots 10 before the startup of rotation of the collet at the end of which the starting drum is mounted. Line D illustrates a diametrical plane of the drum 7.

Figure 10:
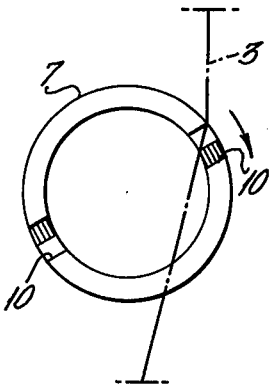
Figure 11:
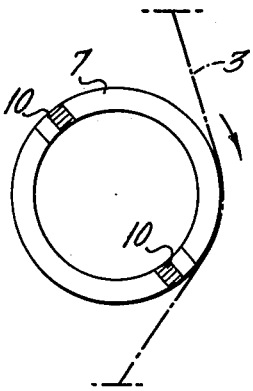
Figure 12:
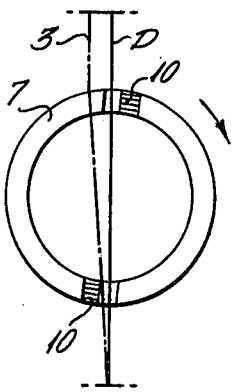
Figure 13:
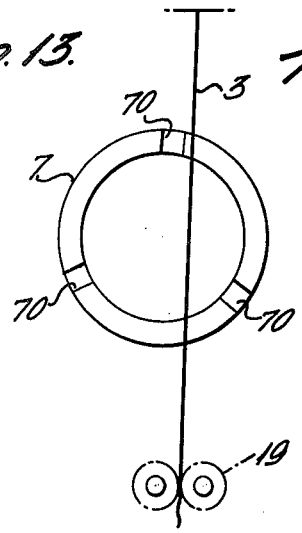
FIGS. 13 through 15 illustrate a starting drum formed in accordance with the teachings of the present invention at different rotational positions.
Figure 14:
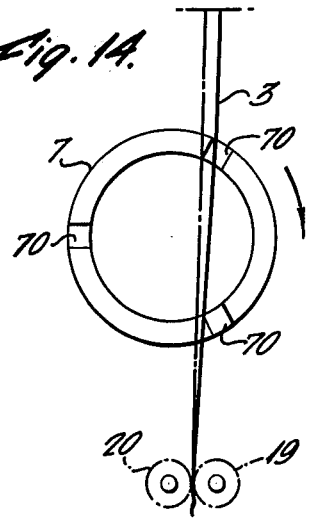
Figure 15:
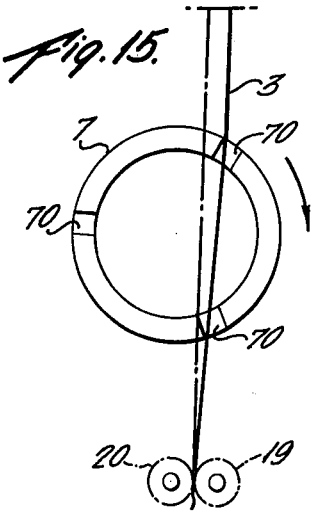
Figure 16:
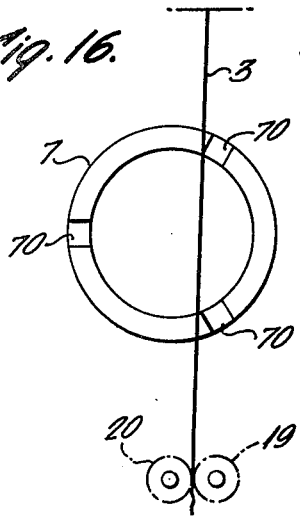
FIGS. 16 through 18 are views similar to FIGS. 13 through 15 showing three other successive positions of operation of this starting drum.

By examining FIG. 9, it is seen that for the thread 3 to be gripped by the two grooves 10, this thread or roving 3 should be situated in a diametrical plane of the starting drum 7. It is possible that this requirement may not be fulfilled at the desired moment, notably in these situations:

(a) malfunction of the maintenance elements that position the roving, for example, the holding finger 11 of the thread and the groove 13 shown in FIGS. 1 to 3. FIGS. 9 to 11 illustrate the faulty functioning when the roving is not in the diametrical plane D. At FIG. 9 is seen that the thread 3, not being in the diametrical plane D, is gripped only by the upper slot; the drum 7, continuing its rotation (FIG. 10), the thread 3, drawn downwardly by the pull-rolls described in FIGS. 1 to 3, begins to leave this groove from which it ultimately totally escapes (FIG. 11).

Figure 17:
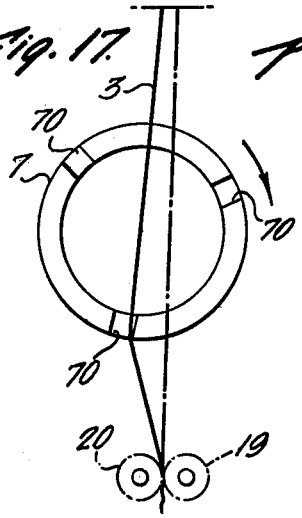
Figure 18:
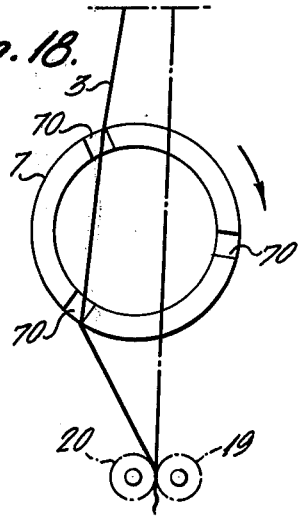

(b) maintaining the roving 3 (FIG. 12) on the face of the starting drum 7 by deposits of solidified size on the face of the drum despite softening by the spray system described in our prior application with regard to FIG. 17; as in the defective functioning described in (a) above, the roving that is no longer situated in the diametrical plane D is only gripped by one slot (the lower slot) and escapes from this slot as described above with regard to FIGS. 9 through 11, before meeting the second slot.

Referring to FIGS. 13 through 18, the starting drum 7 as described above with reference to FIGS. 9 through 12 is shown, but modified in accordance with the invention to provide three gripping elements which are angularly disposed at 120° with respect to one another on its frontal face. In the preferred embodiments of the invention, these gripping elements are made in the form of grooves or notches 70. With this arrangement of gripping elements, the roving 3 is necessarily caught by two successive grooves even though it does not lie within a diametrical plane of the frontal face of the drum 7. The distribution of the slots at 120° relative to one another means that the roving does not have to be precisely aligned to be picked up. Also this disposition of the slots keeps the rotor in balance.

FIGS. 13 through 18 show how the gripping of the thread is accomplished, despite the initial rotational position of the starting drum and despite the fact that the roving is offset from the center of the drum. An examination of these self-explanatory figures shows that in all cases the thread or roving is caught in two consecutive slots of the drum.

Figure 20:
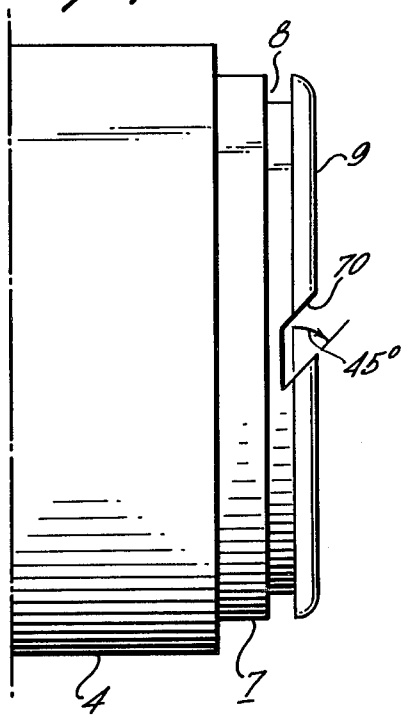
FIG. 20 is an elevational view, showing an example of an embodiment of a gripping element formed according to this invention.

FIGS. 19 and 20 show the collet 4 on which the thread or roving is wound. In FIG. 20 it can be seen that there is provided a groove 8 between the collet and the ring 9 within which the slots or notches 70 are provided. The ring 9 should have a polished, shiny frontal surface with which the threads come into contact.

It has been observed that slippery sizes produce a sliding of the roving along the surface 9 after which the breakage of this roving may occur at the rollers 19 and 20 without the roving being caught by the slots 70. To remedy this disadvantage we prefer to incline the slots at an angle of about 45° on the frontal face 9, the angle preferably being as sharp as possible. Thanks to this characteristic, a clamping of the roving in the base of the slots is always obtained and failures resulting from the slipping of the roving are avoided.

Figure 8:
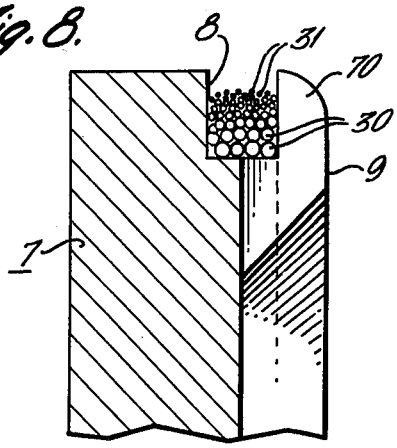
FIG. 8 is a partial cross-sectional view of the starting drum showing strand wound in the groove.

During the start-up of the winding operation and until the collet reaches its normal operating speed, the strand is wound in groove 8. This groove permits the localization and retention of strand composed of large diameter fragile filaments 30 (as shown in FIG. 8) which are susceptible to breakage and separation under the action of centrifugal force. During this start-up operation, as the speed of the collet increases, the strand becomes progressively finer and this finer more breakage resistant strand 31 covers the large diameter filaments 30 at the base of the groove 8 and forms a protective binding over them.

Figure 21:
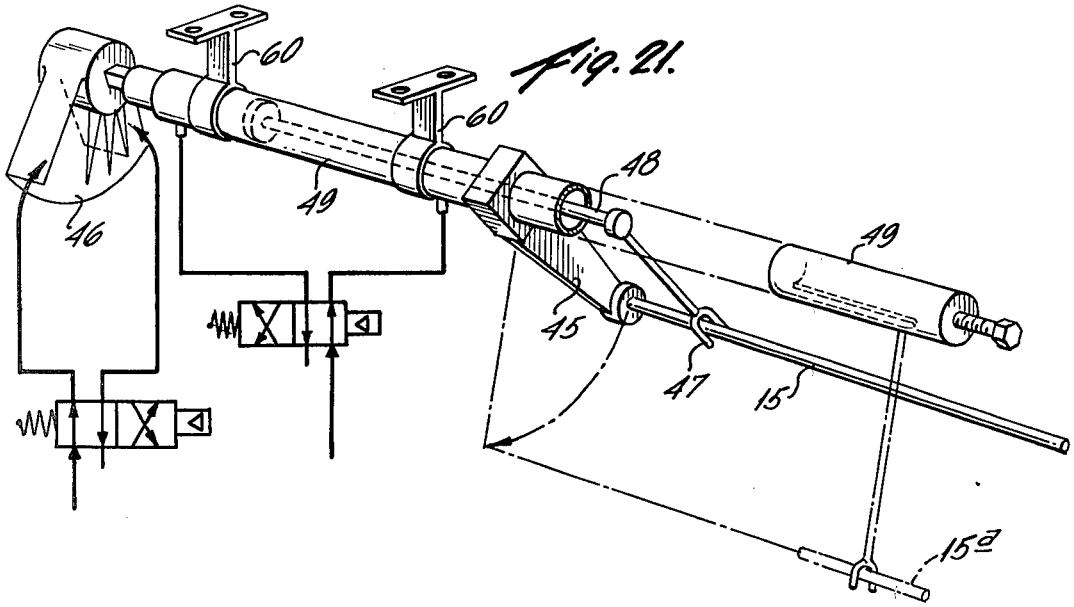
FIGS. 21 and 22 are partial views illustrating a modified form of prior ejection bar.

A time switch controls the pivoting of the bar 15. After a predetermined length of time sufficient for the collet to reach its operating speed, an electrical time switch (not shown) causes operation of means for pivoting the bar 15. Such means can be an electrically actuated valve (for example, as shown in FIG. 21) that controls the flow of fluid to a fluid motor for moving the bar 15 from its rest position to its working position (as shown in FIG. 4). As heretofore explained, when the bar 15 moves to its working position, the deflector element 14 disengages the strand from the retaining finger 11, the strand being retained by the element 14. A second electrical signal given by the time switch after a calculated delay, immediately returns the bar 15 to its rest position. During the time the bar 15 is in its working position, the strand is engaged by the level line mechanism 6 and begins traversing the winding sleeve.

When the winding is completed, in the case of a non-automatic winder, the worker at the winder level stops the collet and removes the winding. In the case of an automatic winder, the collet carrying the full sleeve is moved out of the winding position and the collet with an empty sleeve is moved in position to receive the strand and begin a new winding. The ring of strand formed in the groove 8 of the starting drum is removed by cutting it and lifting it out of the groove.

FIG. 19 shows the position of roller 19 and the retaining finger 11 in respect to the face 9 of the starting drum. It should be noted that in this view roller 20 is not shown. Roller 20 is in the same vertical plane as roller 19 and is inclined in the same direction as roller 19. The axes of the rollers 19 and 20 are inclined at a slight angle to the horizontal, approximately 5°. Further, the groove 13 of finger 11 is recessed in the direction of the axis of rotation of the collet 4 with respect to the face 9. As a result of the foregoing structural relationships, when the strand is drawn by the pulling device 17, the strand is held against the face 9 of the drum and the result of this is that the strand enters the slots 70 in the manner explained above. Further, the inclination of the axes of rotation of the rollers 19 and 20 as shown causes the strand to be pulled in the direction of the arrow f into the base of the V-shaped guide 18. This allows the strand to engage the face 9 and enter the slots 70.

At the time the collet is set into rotation and after catching the strand in a slot 70, the portion of the strand situated between the starting drum and the strand pulling device 17 is subjected to two traction efforts in opposing directions and this produces a rupture of the filaments. It should be realized that because the strand has been drawn slowly at this time, the filaments that comprise the strand are of relatively large diameter and consequently are heavy. If the rupture is very abrupt (all of the filaments breaking substantially at once), the collet will whip the broken end of the strand and under the effect of centrifugal force, the broken end will hit the retaining finger 11 and possibly the strand, with a consequent risk of breaking the strand being wound on the collet.

To lessen this risk, it is advisable to obtain a progressive rupture of the filaments of the strand between the rollers 19 and 20 and the starting drum 7. This result is obtained using rollers 19 and 20 of the type illustrated in FIG. 7 and by regulating the pressure with which they engage the strand at a precise value as explained in the above identified application.

As indicated, in the embodiment discussed above, three equiangularly displaced slots 70 are carried in the face 9 of the starting drum. It is preferred that the slots be displaced from one another by equal angles in order to maintain a proper balance of the starting drum during its rotation. However, in some cases, the slots displaced at other than equal intervals may be provided so long as dynamic balancing means are provided. In such latter arrangements, the slots used at any given time should be displaced from one another by amounts of more than 90° and less than 180°.

FIG. 20 shows, in an elevational view, the collet 4 on which is wound the thread or the roving, as is described above. The The starting drum 7 is affixed on the collet and comprises a groove 8, the slots or notches 70 disposed as above described, and a polished, shiny frontal face 9 with which the roving comes into contact.

Figure 22:
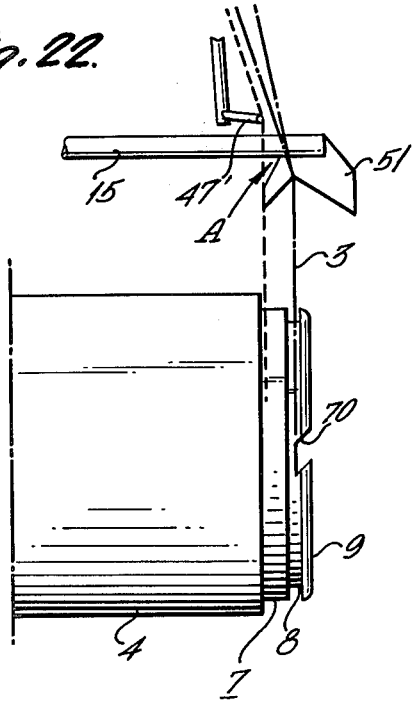
Figure 23:
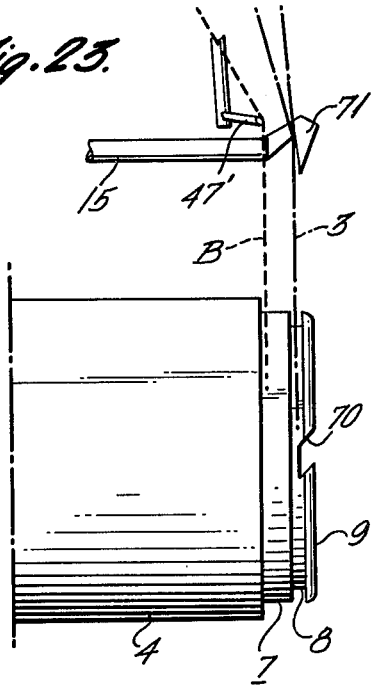
FIG. 23 illustrates a bar used in the apparatus of FIG. 21, modified according to the present invention.

Turn now to FIGS. 21 through 23.

FIG. 21, illustrates another form of strand deflector. In FIG. 21, the fixed retaining finger 11 is replaced by the strand deflector which acts as the upper guide for the strand. The strand deflector used is a known type of deflector. It comprises a bar 15 fixed at one end to a crank 45. When the bar 15 moves to its working position (phantom line position 15*a*) the strand is disengaged from the traversing mechanism 6, the strand being lifted from the transfer bar of that mechanism. Movement of the crank 45 is caused by a rotating jack 46. A fork 47 that is movable the length of the bar 15 pushes the strand or strands to the end of the bar 15. The fork is fixed at one end to bar 48 of a piston of the straight jack 49 mounted on two journals 60 that serve as pivots for the crank 45 carrying the bar 15.

FIG. 22 shows a modified form of the strand ejector used in FIG. 21. This ejector comprises the bar 15 at the end of which is mounted a deflector element 51 having a V-shaped cut which functions to maintain the thread in the groove 8 of the starting drum 7, as disclosed in our earlier filed co-pending application. This element is shaped and positioned so that it does not interfere with the fork 47 when the fork moves the strand off the winding sleeve. However, with this type of V, when the operator starts the roving or the thread 3 into the pull-rolls 17, he risks throwing it into the space A between the bar 15 and one of the branches of the V-shaped deflector 51, thereby passing a position that prevents reliable automatic restarts by the strand being engaged in the slots 70.

To mitigate against this disadvantage, we propose the use of a deflector having a V-shaped groove as shown in FIG. 23. This V, designated by the reference numeral 71, is disposed at the end of the ejection bar 15, and is connected to the bar by the end of one of the two branches of the V. Thanks to this disposition, there is absolutely no risk of binding the thread or the roving between the bar 15 and one of the branches of the V. At the end of a winding operation, the thread is carried to B by the fork 47 that is designed to carry threads on the smooth part 7 that is contiguous to the groove 8 and which functions as a transfer ring.

Another feature of the invention concerns the material from which the rollers 19 and 20 of the pull-roll are made. From tests taken by the Applicant, it became apparent that difficulties were encountered in effecting a progressive cutting of the roving with metallic, thus hard rollers. Thus a material was looked for having less hardness, and guaranteeing in all cases, the success of the operation. The Applicant has found that the best results are obtained with an elastomer, notably a polyurethane resin, having a shore hardness of 95. Preferably, the rollers are obtained by casting the resinous material on a metallic core.

Thus it can be seen that the several features of the invention cooperate to provide for more effective and reliable restarting of a winding operation which make possible the reduction of the number of men employed at the level of the winders, reducing winder down time and the amount of glass lost during strand ruptures.

We claim:

1. Apparatus for drawing and winding a strand of attenuable materials comprising, a collet mounted for rotation about the longitudinal axis thereof, said collet having an end face, strand engaging means on said end face, said strand engaging means comprising three strand engaging devices, each angularly displaced from the others by 120°, a circumferentially extending starting region adjacent the end face, means radially spaced from the longitudinal axis of the collet for continuously drawing strand across the face of said collet and into gripping engagement with two of said strand engaging devices, said strand engaging devices being effective upon rotation of said collet to cause a winding of the strand about the circumferentially extending starting region and means for guiding the strand from the starting region to the collet.

2. Apparatus according to claim 1, wherein said strand engaging means comprising angular notches have side walls slanted in the direction of rotation of the collet and at an acute angle relative to the face of the collet.

3. Apparatus according to claim 2, wherein said side walls of said notches are angled at about 45° relative to the face of the collet.

4. Apparatus according to claim 1, further comprising a strand ejection bar having a guide element comprised of a pair of arms configured to form between them a V-groove for guiding strand, said circumferentially extending starting region defining a circumferential groove on the collet adjacent the face, said guide element being operative for guiding the strand within the circumferential groove until the collet is brought to winding speed, said guide element being characterized in the end of one of said arms away from the apex of the V-groove is affixed to the end of the ejection bar and the end of the other arm extends beyond the end of the ejection bar.

5. Apparatus for winding a continuous strand comprising, a collet mounted for rotation about its longitudinal axis, a face on one end of the collet disposed substantially normally to the axis of rotation of the collet, said collet having a first winding portion adjacent the face wherein the strand is wound during startup of the collet, a second winding portion axially displaced from the first portion on the side of the first portion away from the face, wherein strand is wound following startup, strand pulling means radially disposed with respect to said face for drawing the strand across said face in a manner such that portions of the strand extend beyond two points on the periphery of said face, strand engaging means associated with said face for engaging portions of the strand brought into proximity with the face by the pulling means, said strand engaging means comprising three equidistantly spaced strand engaging elements disposed on the face of the collet adjacent to the circumference thereof, means for conducting the strand from the strand engaging means to said first winding portion, traversing means for cyclically moving the strand longitudinally with respect to the second portion of the collet, and means for shifting the strand axially of said first portion of the collet to the second portion for engagement by the traversing means when the collet reaches a desired windng speed.

6. Apparatus according to claim 5 wherein said strand pulling means comprises pull rolls positioned beneath said collet face, with a portion of the rolls extending outwardly beyond the plane of the face, a guide having a U-shaped recess spaced between the face and the pull rolls, with the apex of the U-shaped recess over the nip between the rolls, the guide and the rolls serving to effect gripping of strand without manual intervention of an operator at the level of the pulling means.

7. Apparatus according to claim 6 wherein said pull rolls are mounted on axes which are inclined relatively to the longitudinal axis of the collet.

* * * * *